US006938453B2

(12) United States Patent
Pickup et al.

(10) Patent No.: US 6,938,453 B2
(45) Date of Patent: Sep. 6, 2005

(54) TOOL FOR APPLYING CLIPS

(75) Inventors: Raymond Allan Pickup, Nantwich (GB); Andrew King, Shavington (GB)

(73) Assignee: J. & H. Rosenheim Limited, Crewe (GB)

( * ) Notice: Subject to any disclaimer, the term of this patent is extended or adjusted under 35 U.S.C. 154(b) by 0 days.

(21) Appl. No.: 10/764,254

(22) Filed: Jan. 23, 2004

(65) Prior Publication Data

US 2004/0148999 A1 Aug. 5, 2004

Related U.S. Application Data

(63) Continuation of application No. PCT/GB02/03290, filed on Jul. 17, 2002.

(30) Foreign Application Priority Data

Jul. 24, 2001 (GB) ..... 0117966.2

(51) Int. Cl.[7] ..... B21D 7/06; B21D 39/00

(52) U.S. Cl. ..... 72/409.04; 72/409.01; 29/566.1; 29/243.56; 140/106

(58) Field of Search ..... 72/409.01, 409.04, 72/389.9; 140/111, 106, 123; 29/566.2, 566.1, 243.56, 243.57; 81/126, 142, 147, 359, 383; 53/138.4

(56) References Cited

U.S. PATENT DOCUMENTS 455,869 A * 7/1891 Jones ..... 72/389.9
738,216 A * 9/1903 Littley ..... 81/347
1,906,854 A * 5/1933 Heinrich ..... 72/389.9
2,218,313 A * 10/1940 Hamilton et al. ..... 81/359
2,941,431 A * 6/1960 Christensen et al. ..... 29/566.1
2,945,237 A * 7/1960 Smith ..... 72/411
3,210,835 A * 10/1965 Tipper ..... 29/243.57
3,224,083 A * 12/1965 Tipper ..... 29/243.57
3,327,514 A * 6/1967 Tipper ..... 72/416
4,312,108 A * 1/1982 Tipper ..... 29/243.56
4,313,333 A 2/1982 Malagnoux et al. ..... 72/410
4,807,345 A * 2/1989 Jacobson ..... 29/243.56

FOREIGN PATENT DOCUMENTS

GB 877228 9/1961
GB 2169828 A 12/1985

* cited by examiner

*Primary Examiner*—Daniel C. Crane
(74) *Attorney, Agent, or Firm*—Baker Botts L.L.P.

(57) ABSTRACT

A closure tool (10, 40) for closing heavy-duty clips (11) as used for example in the building trade and in agriculture has a body (13), a pair of handles (14) mounted on the body (13) on pivots (15) and a pair of anvils (18, 20) movable relative to each other from a spaced position to closure position in response to relative movement of the handles (14) and the body (13). A moving member (17) is engaged by the handles (14) and is movable therewith, and one of the anvils (18) is connected to and movable with the moving member (17). The handles (14) may have spigots (44) engaged in a slot (43) in a cylindrical moving member (17) in a barrel part (41) of the body (13), or each handle (14) may have a quadrant shaped first gear engaging a rack second gear moving member slidably mounted in the body.

48 Claims, 4 Drawing Sheets

TOOL FOR APPLYING CLIPS

CROSS REFERENCE TO RELATED APPLICATION

This application is a continuation of copending International Application No. PCT/GB02/03290 filed Jul. 17, 2002 which designates the United States, and claims priority to Great Britain application no. 0117966.2 filed Jul. 24, 2001.

TECHNICAL FIELD OF THE INVENTION

The present invention relates to closure tools, and in particular to tools for closing heavy-duty clips as used for example in the building trade and in agriculture.

DESCRIPTION OF THE RELATED ART

It is known to use a closure tool for closing heavy duty clips to fasten together sections of mesh and the like as used in the building trade and in agriculture, for constructing animal cages, enclosures or the like, or in constructing fences on farms, building sites or the like.

Such tools usually consist of a magazine for an assembly of clips and a jaw arrangement to which the clips are fed singly in sequence. The jaws are moved pneumatically to force the clip that has been introduced between them into a closed configuration around the wires of the mesh, thereby securing two sections of mesh together. Alternatively, the jaws may be moved by hydraulic or electrical power. Such tools are useful in locations having an accessible source of air, hydraulic or electrical power. However, it is often required to use install such clips in locations remote from sources of such power, and the use of portable sources of power is cumbersome and inconvenient. Hand tools for performing various functions are known. In such cases, where considerable effort is required to perform the function, either very long handles or a system of levers is employed to make the applied forces required within the capabilities of a person performing the function, e.g. long handled shears, tree loppers and the like. Such tools may still require considerable effort by the user unless the tool is large and heavy, in which case the tools are unwieldy to transport and in use. In addition, such tools can be difficult to control to effect a function such as clip closure accurately.

SUMMARY OF THE INVENTION

It is an object of the present invention to provide a closure tool that is useable in locations that do not have a source of pneumatic, hydraulic or electrical power readily available. It is a further object of the invention to provide a closure tool that is convenient to use and provides accurate control of the function for which the tool is to be used.

The invention provides a closure tool for a clip, comprising a body, at least one handle movably mounted thereon and a pair of anvils movable relative to each other from a spaced position to closure position in response to relative movement of the at least one handle and the body, characterized in that a moving member is contacted by the at least one handle and is movable therewith, and at least one of the anvils is connected to the moving member to be movable therewith.

The other anvil may be secured to the body. The anvils may have cooperating formations thereon providing a closing chamber for a clip when the anvils are in the spaced disposition.

The closing chamber may be substantially circular when the anvils are in the closure position.

The at least one handle may be pivotally mounted in the body. The closure tool may comprise a pair of handles movably mounted in the body and a pair of anvils movable relative to each other from a spaced position to closure position in response to relative movement of the handles. In this case, each handle may be pivotally mounted in the body. The moving member may be slidably mounted in the body.

The at least one handle may have a spigot thereon and the moving member may have a slot therein engaged by the spigot.

A first gear member may be connected to the at least one handle and movable therewith, and the moving member may comprise a second gear member engaged by the first gear member and movable therewith. At least one of the anvils may be connected to the moving second gear member to be movable therewith. The first gear member may comprise a circular gear wheel and may comprise a sector thereof. The moving second gear member may comprise a rack slidably mounted in the body. The at least one anvil may be an end part of the moving second gear member.

Each handle may be connected to a respective first gear member. The moving second gear member may be engaged by each first gear member, and may have gear formations on opposed sides thereof, each gear formation being engaged by a respective first gear member.

The closure tool may have a magazine adapted to receive a plurality of clips. The magazine may be mounted on the body whereby an outlet end of the magazine is disposed adjacent the closing chamber. The magazine may comprise a spring device adapted in use of the closure tool to force a plurality of clips towards the outlet end of the magazine. The at least one anvil may have a severing edge thereon adapted to sever a leading clip adjacent the outlet end of the magazine from a plurality of clips received in the magazine and move the leading clip into the closing chamber. The magazine may be arcuate. The magazine and anvils may be removable from the body and re-attachable thereto in a plurality of angular dispositions relative to the plane of movement of the at least one handle. The closure tool may be of aluminum.

BRIEF DESCRIPTION OF THE DRAWINGS

The invention will now be described with reference to the accompanying drawings in which.

DETAILED DESCRIPTION OF THE PREFERRED EMBODIMENTS

Figure 1:
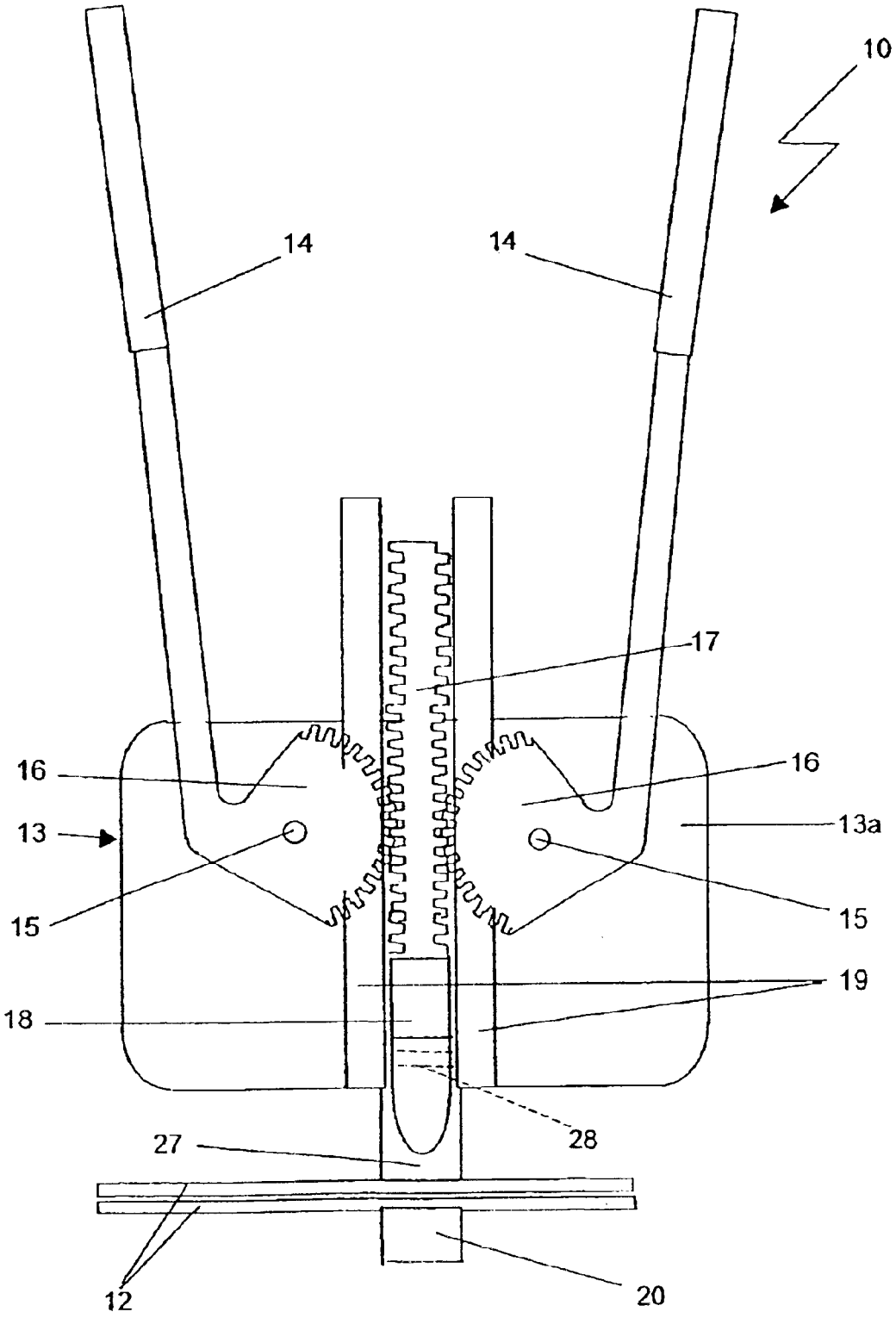
FIG. 1 is a front view of a first embodiment of closure tool.
Figure 2:
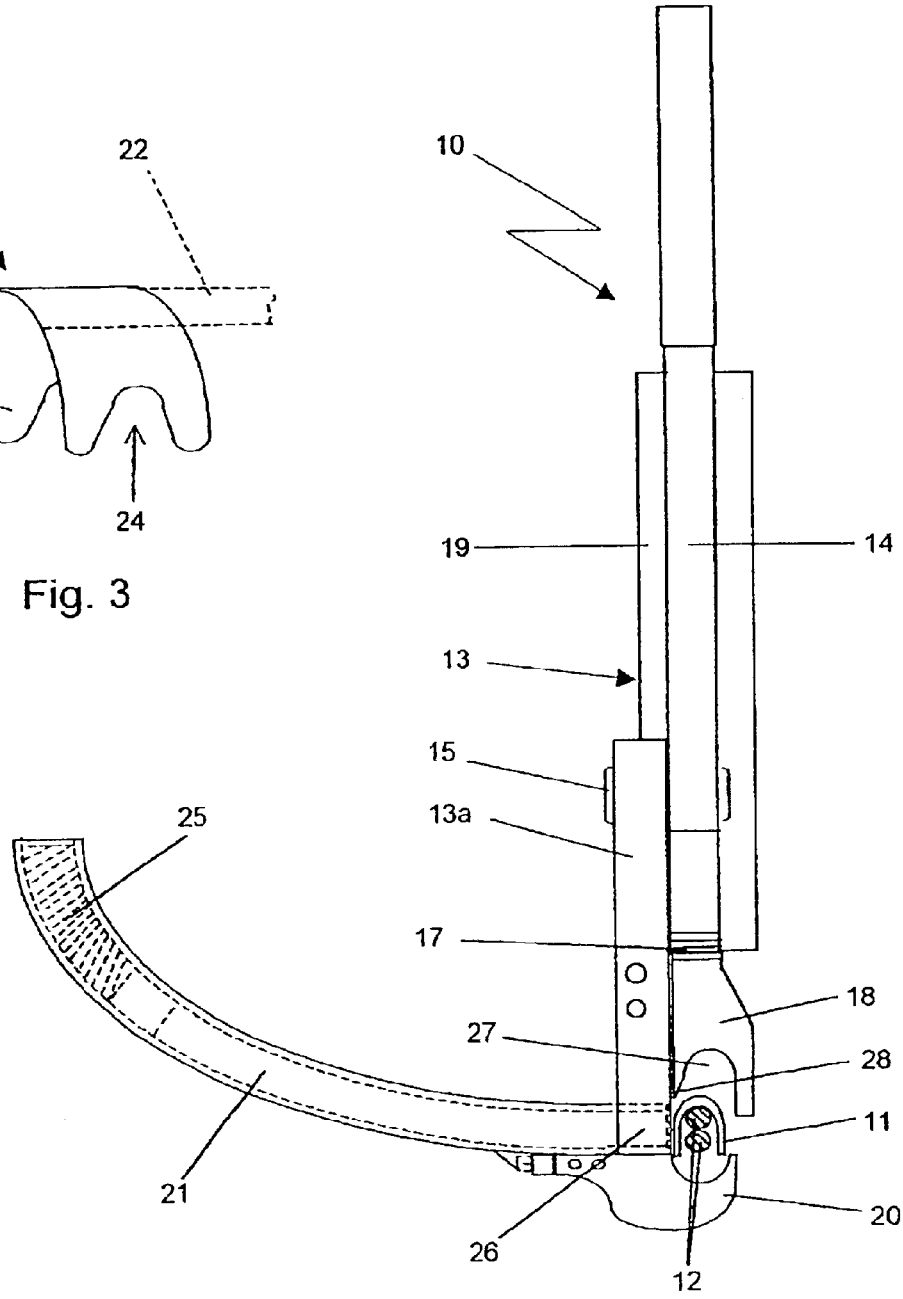
FIG. 2 is a side view of the closure tool of FIG. 1.

Referring now to FIGS. 1 and 2, there is shown a closure tool 10 for closing heavy duty clips 11 to fasten together wires or sections of mesh 12 and the like as used in the building trade and in agriculture. The closure tool 10 consists of a body 13, including a top plate 13*a* on which two handles 14 are mounted on pivots 15. Attached to or integral with each handle 14 is a first gear member 16 in the form of a sector of a circular gear wheel. The center of curvature of each first gear member 16 is the respective pivot 15.

Intermeshing with the two first gear members 16 is a moving or second gear member 17 in the form of a double-sided rack.

Attached to or integral with the moving second gear member 17 is a first anvil 18. The first anvil 18 and the moving second gear member 17 are guided by two side plates 19 to move along a linear path when the handles 14 are moved towards each other or away from each other. Attached to or integral with the body 13 is a second anvil 20. Also mounted on the body 13 is a curved magazine 21 for storing an assembly of clips 11 for use by the closure tool 10. The body 13, handles 14, first and moving second gear members 16, 17 and magazine 21 are of aluminum to minimize the weight of the closing tool 10.

Figure 3:
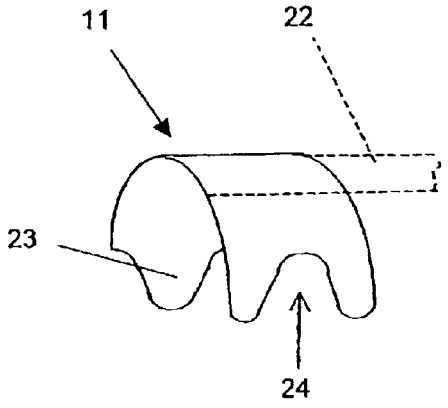
FIG. 3 is a perspective view to an enlarged scale of a clip for use in the closure tools of FIGS. 1 and 2 and FIGS. 4 and 5.

In use, operation of the closure tool 10 is as follows. The handles 14 are moved away from each other so that the anvils 18,20 are spaced apart. An assembly of clips 11 is placed in the magazine 21. The clips 11 are temporarily secured to each other in side-by-side disposition by a tape 22 (shown in dashed lines in FIG. 3). Each clip 11 is formed into a U-shape and is formed with a tongue 23 at one end and a correspondingly shaped cut-out 24 at the other end. The assembly of clips 11 is forced by a spring 25 towards the outlet end 26 of the magazine 21 so that the leading clip 11 is disposed adjacent a closing chamber 27 formed between the first anvil 18 and the second anvil 20. The closure tool 10 is placed so that the wires, mesh or the like 12 to be secured together pass through the closing chamber 27. The handles 14 are then moved towards each other, causing rotation of the first gear members 16 about the pivots 15. This in turn causes the moving second gear member 17 together with the first anvil 18 to move relative to the body 13 and the second anvil 20. A severing edge 28 formed on the first anvil 18 cuts the tape 22 to allow the leading clip 11 to move properly into the closing chamber 27 and around the wires 12. Movement of the first anvil 18 towards the second anvil 20 progressively reduces the longitudinal extent of the closing chamber 27. The opposed surfaces of the closing chamber 27 in the first and second anvils 18, 20 are of circular form so that the ends 23,24 of the clip 11 are forced towards each other. The clip 11 eventually is formed substantially into a circular shape surrounding the wires 12 with the tongue 23 received in the cut-out 24. The handles 14 are then moved away from each other to move the first and second anvils 18,20 apart and the closure tool 10 is removed from the wires 12.

Figure 4:
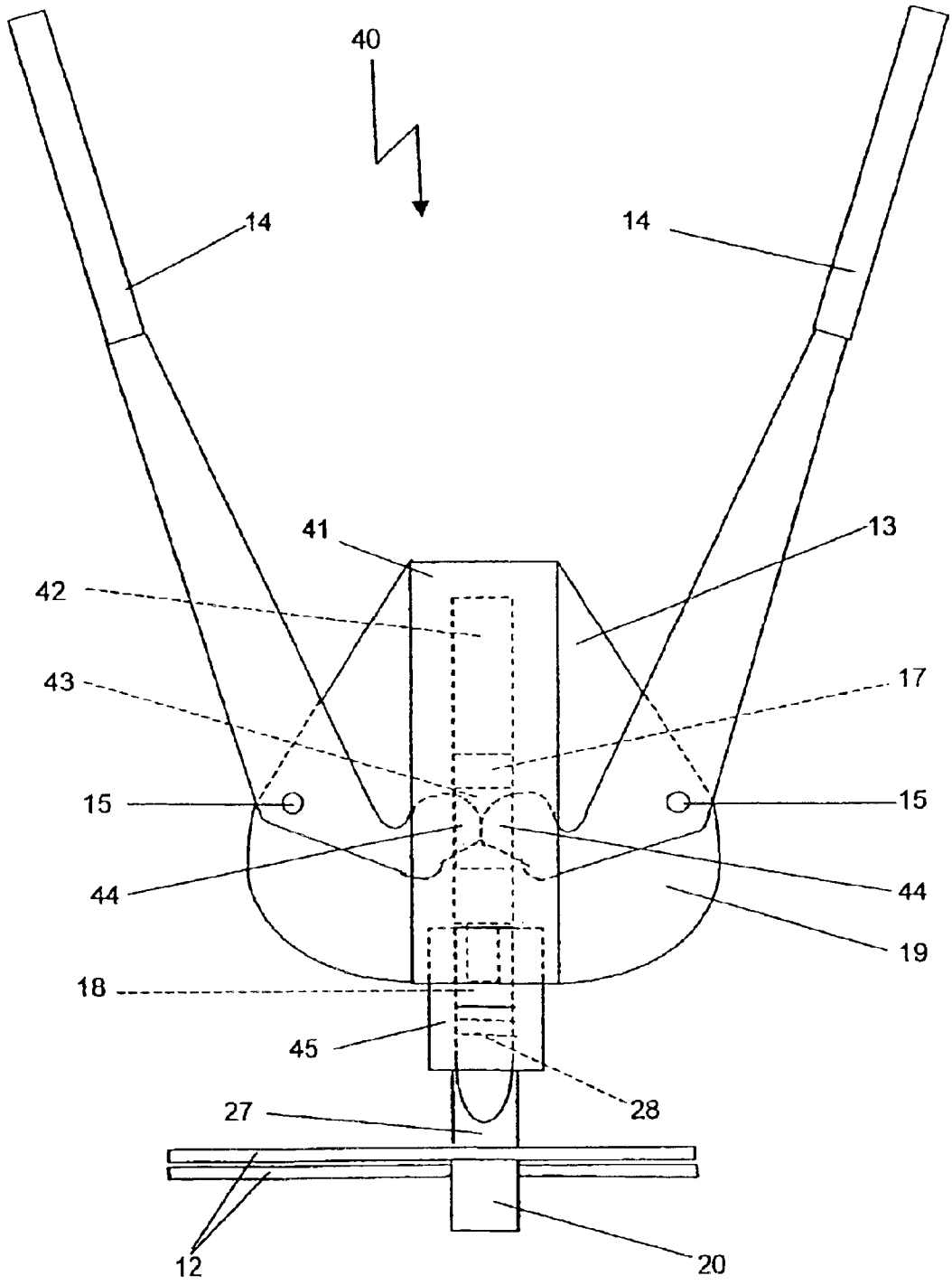
FIG. 4 is a front view of a second embodiment of closure tool.
Figure 5:
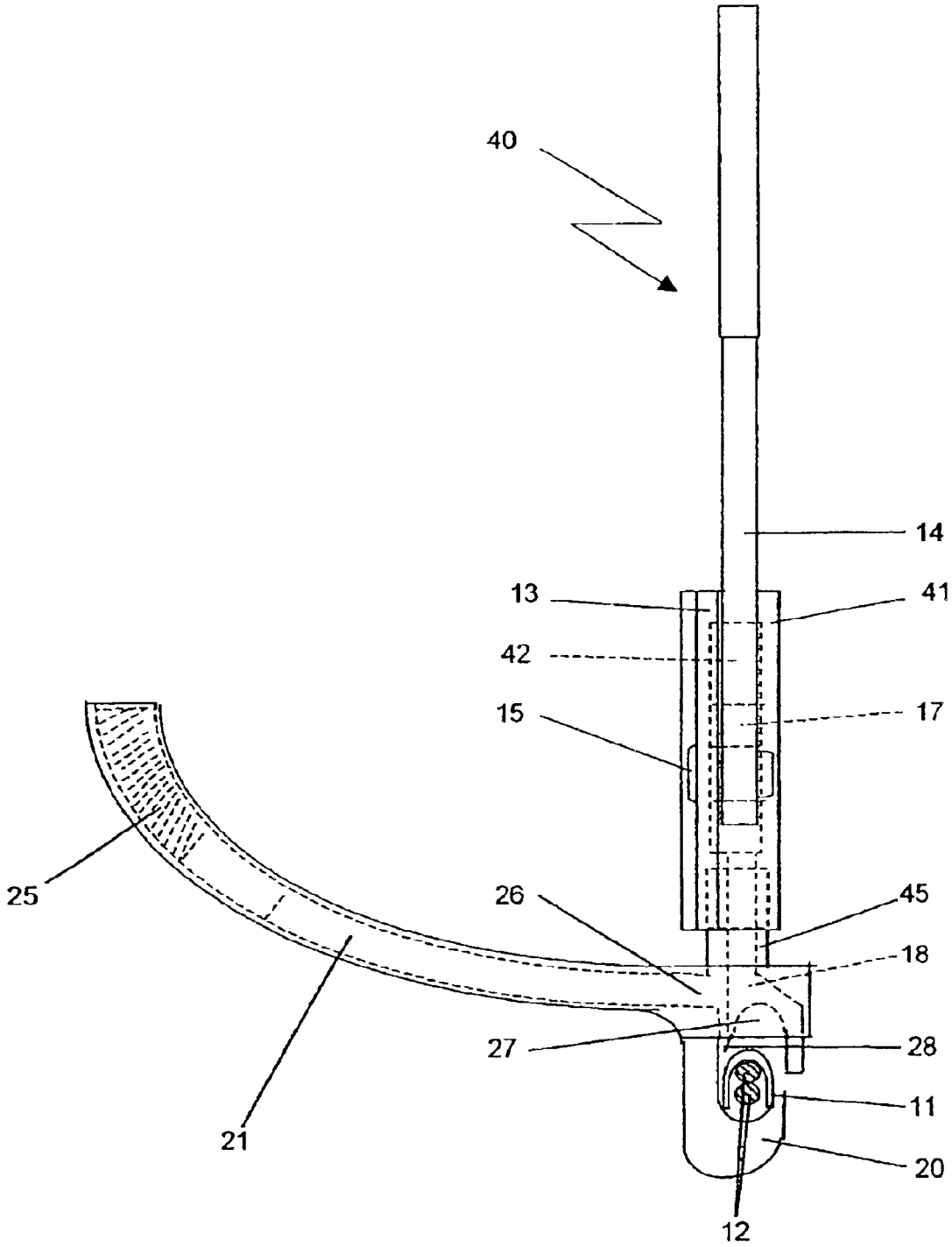
FIG. 5 is a side view of the closure tool of FIG. 4

Referring now to FIGS. 4 and 5, there is shown a second embodiment of closure tool 40. Parts of the closure tool 40 corresponding with similar parts of closure tool 10 are identified by corresponding numerals. Operation of closure tool 40 is the same as operation of closure tool 10, but the construction of the two tools 10,40 differs as follows. In the case of closure tool 40, the handles 14 are pivoted at 15 on a body 13 that has a barrel part 41. Slidably contained in the barrel part 41 is a cylindrical moving member 17 having a slot 43 therethrough. Spigots 44 on the handles 14 engage in the slot 43 so that when the handles 14 are moved towards or away from each other, the moving member 17 slides along the bore 42 of the barrel part 41. Detachably connected to the moving member 17 so as to be movable therewith is the first anvil 18. The magazine 21 and second anvil 20 are attached to a mounting block 45 through which the first anvil 18 slides when moving in response to movement of the handles 14. For convenience of use in differing situations, this mounting block 45 is detachably secured to the barrel part 41 of the body 13, and as mentioned above the first anvil 18 is detachably connected to the moving member 17. By virtue of this construction, the magazine 21 can be located in a plurality of angular dispositions relative to the plane of movement of the handles 14. In FIGS. 4 and 5 the magazine 21 is shown extending to the rear of the closure tool 40, but by repositioning the mounting block 45 in the body 13, the magazine 21 may extend to the front or either side of the closure tool 40.

By means of the invention, a closure tool is provided that is convenient to use in any location that has no power source available. The closure tool of the invention is relatively compact and readily transportable. The rack and gear wheel arrangement or spigots and cylindrical moving member arrangement provide that the operation of the closure tool is smoother and more controlled than with known arrangements using very long handles and/or lever mechanisms.

Other embodiments of closure tool within the scope of the invention will be readily apparent to persons skilled in the art. For example, both anvils may be movable relative to the body and each other, with one handle connected to one anvil and the other handle connected to the other anvil. Alternatively, one handle may be secured to or integral with the body and one anvil, with the other handle movable relative thereto and connected to the other, movable, anvil. As a further alternative, the movable anvil may be attached to a circular second gear so that it moves in an arcuate path towards the other anvil. In such a case, the movement of one handle relative to the body and the other handle may be linear. The closure tool may be made of any suitable material, such as a plastics material if such material is adequately strong for the intended use to which the tool is to be put. If preferred, the magazine may be dispensed with and the clips may be loaded into the closing chamber individually.

We claim:

1. A closure tool for a clip, comprising a body, a pair of handles pivotally and movably mounted thereon and a pair of anvils movable relative to each other from a spaced position to a closure position in response to relative movement of the handles and the body, a moving member contacted by the handles, the moving member being slidably mounted in the body, and at least one of the anvils being connected to the moving member to be movable therewith, wherein the handles and the moving member have cooperating formations thereon whereby the moving member is movable with the handles, and wherein the handles have a spigot thereon and the moving member has a slot therein engaged by the spigots.

2. The closure tool according to claim 1, wherein the other anvil is secured to the body.

3. The closure tool according to claim 1, wherein the anvils have co-operating formations thereon providing a closing chamber for a clip when the anvils are in the spaced disposition.

4. The closure tool according to claim 3, wherein the closing chamber is substantially circular when the anvils are in the closure position.

5. The closure tool according to claim 1, wherein the at least one handle is pivotally mounted on the body.

6. The closure tool according to claim 1, wherein a first gear member is connected to the handles and movable therewith, and the moving member comprises a second gear member engaged by the first gear member and movable therewith.

7. The closure tool according to claim 6, wherein the first gear member comprises a circular gear wheel.

8. The closure tool according to claim 7, wherein the first gear member comprises a sector of a circular gear wheel.

9. The closure tool according to claim 7, wherein the moving second gear member comprises a rack slidably mounted in the body.

10. The closure tool according to claim 9, wherein the other anvil is an end part of the moving second gear member.

11. The closure tool according to claim 10, wherein each handle is connected to a respective first gear member.

12. The closure tool according to claim 11, wherein the moving second gear member is engaged by each first gear member.

13. The closure tool according to claim 12, wherein the moving second gear member has gear formations on opposed sides thereof, each gear formation being engaged by a respective first gear member.

14. The closure tool according to claim 1, comprising a magazine adapted to receive a plurality of clips.

15. The closure tool according to claim 14, wherein the magazine is mounted on the body whereby an outlet end of the magazine is disposed adjacent the closing chamber.

16. The closure tool according to claim 15, wherein the magazine comprises a spring device adapted in use of the closure tool to force a plurality of clips towards the outlet end of the magazine.

17. The closure tool according to claim 15, wherein the at least one anvil has a severing edge thereon adapted to sever a leading clip adjacent the outlet end of the magazine from a plurality of clips received in the magazine and move the leading clip into the closing chamber.

18. The closure tool according to claim 15, wherein the magazine is arcuate.

19. The closure tool according to claim 15, wherein the magazine and anvils are removable from the body and re-attachable thereto in a plurality of angular dispositions relative to the plane of movement of the at least one handle.

20. The closure tool according to claim 1, wherein the closure tool is made of aluminum.

21. A closure tool for a clip, comprising a body, a pair of handles movably mounted thereon and a pair of anvils movable relative to each other from a spaced position to closure position in response to relative movement of the handles and the body, wherein a moving member is contacted by the at least one handle and is movable therewith, the moving member is slidably mounted in the body, at least one of the anvils is connected to the moving member to be movable therewith, a first gear member comprising a circular gear wheel is connected to the at least one handle and movable therewith, and the moving member comprises a second gear member engaged by the first gear member and movable therewith, and wherein the moving second gear member comprises a rack slidably mounted in the body.

22. The closure tool according to claim 21, wherein the other anvil is secured to the body.

23. The closure tool according to claim 21, wherein the anvils have co-operating formations thereon providing a closing chamber for a clip when the anvils are in the spaced disposition.

24. The closure tool according to claim 23, wherein the closing chamber is substantially circular when the anvils are in the closure position.

25. The closure tool according to claim 21, wherein the at least one handle is pivotally mounted on the body.

26. The closure tool according to claim 21, wherein the handles have a spigot thereon and the moving member has a slot therein engaged by the spigots.

27. The closure tool according to claim 21, wherein the first gear member comprises a sector of a circular gear wheel.

28. The closure tool according to claim 21, wherein the other anvil is an end part of the moving second gear member.

29. The closure tool according to claim 28, comprising a pair of handles movably mounted on the body and wherein each handle is connected to a respective first gear member.

30. The closure tool according to claim 29, wherein the moving second gear member is engaged by each first gear member.

31. The closure tool according to claim 30, wherein the moving second gear member has gear formations on opposed sides thereof, each gear formation being engaged by a respective first gear member.

32. The closure tool according to claim 21, comprising a magazine adapted to receive a plurality of clips.

33. The closure tool according to claim 32, wherein the magazine is mounted on the body whereby an outlet end of the magazine is disposed adjacent the closing chamber.

34. The closure tool according to claim 33, wherein the magazine comprises a spring device adapted in use of the closure tool to force a plurality of clips towards the outlet end of the magazine.

35. The closure tool according to claim 33, wherein the at least one anvil has a severing edge thereon adapted to sever a leading clip adjacent the outlet end of the magazine from a plurality of clips received in the magazine and move the leading clip into the closing chamber.

36. The closure tool according to claim 33, wherein the magazine is arcuate.

37. The closure tool according to claim 33, wherein the magazine and anvils are removable from the body and re-attachable thereto in a plurality of angular dispositions relative to the plane of movement of the at least one handle.

38. The closure tool according to claim 21, wherein the closure tool is made of aluminum.

39. A closure tool for a clip, comprising a body, a pair of handles pivotally and movably mounted thereon and a pair of anvils movable relative to each other from a spaced position to a closure position in response to relative movement of the handles and the body, a moving member contacted by the handles, the moving member being slidably mounted in the body, and at least one of the anvils being connected to the moving member to be movable therewith, wherein the handles and the moving member have cooperating formations thereon whereby the moving member is movable with the handles, wherein a first gear member is connected to the handles and movable therewith, and the moving member comprises a second gear member engaged by the first gear member and movable therewith, wherein the first gear member comprises a circular gear wheel, and wherein the moving second gear member comprises a rack slidably mounted in the body.

40. The closure tool according to claim 39, wherein the first gear member comprises a sector of a circular gear wheel.

41. The closure tool according to claim 39, wherein the other anvil is an end part of the moving second gear member.

42. The closure tool according to claim 41, wherein each handle is connected to a respective first gear member.

43. The closure tool according to claim 42, wherein the moving second gear member is engaged by each first gear member.

44. The closure tool according to claim 43, wherein the moving second gear member has gear formations on opposed sides thereof, each gear formation being engaged by a respective first gear member.

45. A closure tool for a clip, comprising a body, a pair of handles movably mounted thereon and a pair of anvils movable relative to each other from a spaced position to a closure position in response to relative movement of the handles and the body, a moving member contacted by the handles, the moving member being slidably mounted in the body, at least one of the anvils being connected to the moving member to be movable therewith, wherein the handles and the moving member have cooperating formations thereon whereby the moving member is movable with the handles, and a magazine adapted to receive a plurality of clips, wherein the magazine is mounted on the body whereby an outlet end of the magazine is disposed adjacent a closing chamber, wherein the at least one anvil has a severing edge thereon adapted to sever a leading clip adjacent the outlet end of the magazine from a plurality of clips received in the magazine and move the leading clip into the closing chamber.

46. The closure tool according to claim 45, wherein the magazine comprises a spring device adapted in use of the closure tool to force a plurality of clips towards the outlet end of the magazine.

47. The closure tool according to claim 45, wherein the magazine is arcuate.

48. The closure tool according to claim 45, wherein the magazine and anvils are removable from the body and re-attachable thereto in a plurality of angular dispositions relative to the plane of movement of the at least one handle.

* * * * *